US005735790A

United States Patent [19]

Håkansson et al.

[11] Patent Number: 5,735,790

[45] Date of Patent: Apr. 7, 1998

[54] DEVICE IN HEARING AIDS

[75] Inventors: Bo Håkansson, Göteborg; Peder Carlsson, Kungälv, both of Sweden

[73] Assignee: P & B Research AB, Goteborg, Sweden

[21] Appl. No.: 565,996

[22] Filed: Dec. 1, 1995

[30] Foreign Application Priority Data

Dec. 2, 1994 [SE] Sweden ..... 9404188

[51] Int. Cl.[6] ..... H04R 25/00

[52] U.S. Cl. ..... 600/25

[58] Field of Search ..... 600/25; 381/68, 381/68.3, 69; 607/55, 57; 403/76, 122, 141, 142

[56] References Cited

U.S. PATENT DOCUMENTS 4,498,461 2/1985 Hakansson ..... 381/68.3

4,904,233 2/1990 Hakansson et al. ..... 600/25

5,345,509 9/1994 Hofer et al. ..... 381/68.3

*Primary Examiner*—Lee S. Cohen

*Assistant Examiner*—Bryan K. Yarnell

*Attorney, Agent, or Firm*—Woodbridge & Associates

[57] ABSTRACT

A device for interconnecting an implant (2) anchored in the skull bone of a person with impaired hearing, which acts as or supports a first coupling part (7) and a second coupling part (14) interconnectable therewith and connected to a vibration exciting apparatus, whereby said coupling parts are constituted by a substantially cup-shaped female part (7) and a male part (14), which is insertable therein under mutual flexing, the female part (7) being designed as a rigid cup-shaped seat, whereas the male part (14) is designed to be resilient in radial direction in order to permit a snap-in introduction into the female part (7).

7 Claims, 4 Drawing Sheets

DEVICE IN HEARING AIDS

BACKGROUND OF THE INVENTION

The present invention refers to a device in hearing aids intended for interconnecting an implant acting as a first coupling member and being anchored in the skull bone of a person with impaired hearing and a second coupling part interconnectable therewith and being provided on a vibration exciting apparatus, whereby said coupling parts are constituted by a substantially cup-shaped female part and a male part, which is insertable therein under mutual flexing.

For this purpose there are earlier known different embodiments of interconnection devices. Such skull bone anchored implants are often made as a titanium fixture, in which a metallic, first coupling part is arrestable. To this first coupling part, which thus is arrestable in the fixture, is connectable a second coupling part cooperating therewith and being connected to the vibration exciting part of the hearing aid.

The second coupling part has also been made in metal and in order to provide a sufficiently stable interconnection of the two coupling parts and a safely (distortion free) signal transferring contact between the metal surfaces engaging each other, it has been necessary to machine these metallic coupling parts to a rather high accuracy, which in view of the metallic materials, which can be used, has been connected to rather high costs.

At earlier embodiments the coupling parts often have been made as a female coupling part and a male coupling part, wherein the male part usually has been made as an at least partially ball-shaped body, whereas the female part has been constituted by a cup-shaped body, the wall of which has been made sufficiently elastic to permit the male part to be snapped-in, in that the edge portion has been made sufficiently thin, or more often, has been provided with axially extending slots. In another embodiment the coupling parts have been designed as a bayonet coupling.

In all these cases the male part has been designed as a form stiff body, whereas the female part has been designed to be able to flex, or has been provided with flexing means for making it possible to effect interconnection and disconnection of the coupling parts manually.

At skin penetrating implants it is desirable that the side (the outer side) of the implant facing the soft tissue is kept as clean as possible. An obvious drawback with a skin penetrating implant where the male part is fitted to the patient, thus is that the female part of the hearing aid, which is often coated with dirt (germs), etcetera, transfers these to the outer side of the implant and the risk for spreading to the skin penetration area is obvious. As the skin thickness at the penetration area varies from one patient to another and at certain patients grows with time, there is always the risk that direct contact between the female part and the skin may occur, which with the highest probability results in skin irritation/skin infection. In order to minimize this risk it is required a male part, which with margin projects out from the skin, which in turn means an increased risk for outer and unwanted physical influence of the implant.

Another drawback at the coupling device comprising two cooperating metallic parts is that at use of external, electrically driven equipment, for patient safety reasons specialized equipment must be used, e.g. in form of protective transformer in order not to risk that the bearer is subjected to harmful current levels via the hearing aid, and the electrically conductive coupling device. Today this is required for permitting plugging in of a tape recorder/WALKMAN.

SUMMARY OF THE INVENTION

The purpose of the present invention is to provide a device of the type described in the introduction, by which the above mentioned drawbacks are eliminated, and this has been obtained by the features defined in the accompanying claims.

Hereinafter the invention will be further described with reference to an embodiment shown in the accompanying drawings.

DETAILED DESCRIPTION OF THE INVENTION

Figure 1:
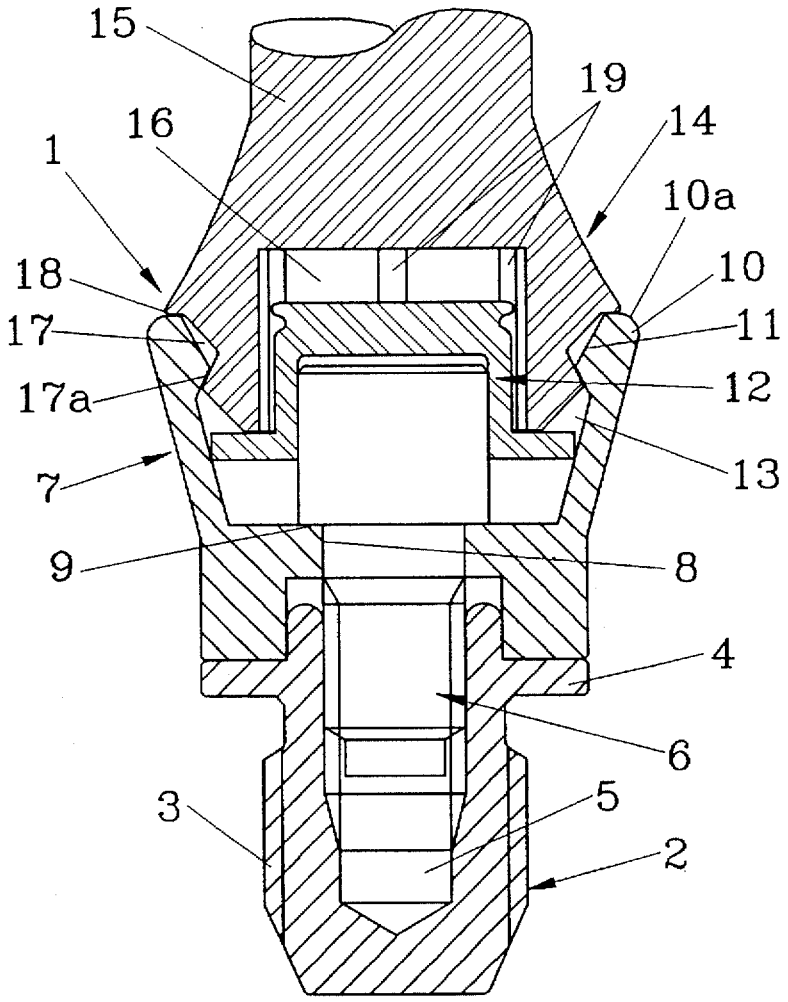
FIG. 1 shows in a transversal section a coupling device according to the invention in coupling position.

FIG. 1 shows in cross section a coupling device 1 according to the invention, which incorporates a flange fixture 2 formed as an implant, intended to be inserted by an operation, preferably in the skull bone of the bearer of the hearing aid. The flange fixture or the implant 2 is manufactured from metal and preferably from titanium and it is provided with a substantially cylindrical attachment part 3, which adjacent one of its ends is equipped with a radial flange 4, arranged in implanted position to engage with one of its annular surfaces against the skull bone. In the cylindrical portion of the flange fixture there is provided a threaded blind hole 5, which is adapted and intended to receive a spacer screw 6 which is arrestable in thread engagement therewith. The spacer screw 6 is arranged to anchor to the flange fixture 2 a first coupling part 7, in form of substantially cup-shaped male part made from metal, preferably titanium, and having a centrum through-bore 8, through which the stem of the spacer screw 6 extends, and which with the edge of the screw head engaging an annular seat 9 around the bore 8 creates an anchoring of the first coupling part 7 to the flange fixture 2. On the side of the first coupling part 7 turned away from the flange fixture 2, this part is equipped with an axial outwardly tapering annular side wall 10 at a distance from the annular seat 9, with an annular external end surface 10*a* and an inwardly projecting concentric annular bead 11 adjacent the external end surface 10*a*.

The head of the screw 6 thus protrudes upwards inside the space formed by the side wall 10 in the first coupling part, whereby the head of the screw does not completely fill out this space thus that a annular space is formed. In the area nearest to base of the side wall 10 this space is filled to a substantial part of the lower portion of a cap-formed covering washer 12 arranged over the screw head and which in its upper potion however has smaller diameter and there leaves an annular slot 13, which extends from the outer end of the conically flaring side wall 10 and beyond its inwardly directed annular bead 11. As the first coupling part 7 is designed as a rigid metal structure made from a high-quality material it has substantially no resiliency whatsoever, not even at the outer end of its conically flaring side wall 10. The covering washer 12 is preferably manufactured from plastic material, and is used mainly for aesthetic reasons.

Figure 2:
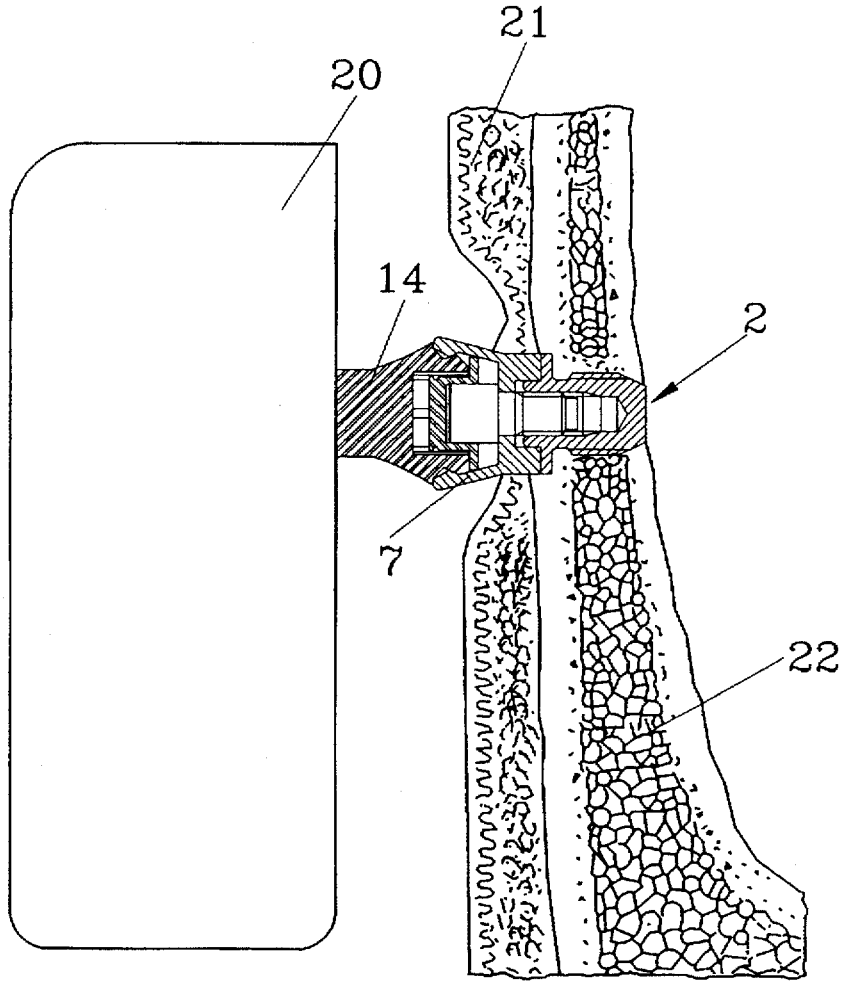
FIG. 2 is an illustration of a skull bone implanted coupling device according to the invention with a hearing aid connected thereto, with coupling device and skull bone shown in cross section.

The coupling device according to the invention also incorporates a second coupling part 14, which, as can be seen from FIG. 2, in a proper, not further shown manner with a shaft portion 15 is connected to a hearing apparatus 20, of a type known per se, and in FIG. 2 is also shown how the implant 2 penetrates the skin 21 and is anchored in the skull bone 22.

This second coupling part 14 is made as a male part with a recess 16 arranged in the forward portion thereof and concentric therewith, and being of a size, permitting that the recess is brought down over and with clearance encloses the screw head or the covering washer 12 in the upper portion thereof.

The second coupling part or the male part 14 at its recess-provided end is equipped with a circumferential groove 17 with an engagement surface 17*a* formed at the free edge and adapted to form a seat for the annular bead 11 when the male part 14 is introduced into the annular slot 13 in the first coupling part or the female part 7. The male part 14 is also provided with a radial, circumferential flange 18, which when the annular bead 11 is situated against the engagement surface 17*a* in the groove 17 in the male part on one hand and on the other hand engages the end surface 10*a* on the female part 7. Hereby the annular engagement surfaces between the end surface 10*a* and the flange 18 and also between the edge of the annular bead 11 and the engagement surface 17*a*, form signal transferring surfaces between the first 7 and second 14 parts of the coupling device.

The portion of the second coupling part—the male part 14—having the inner recess 16, is made resilient in order to permit simple snap-in introduction of the male part 14 into the annular slot 13 in the female part 7.

This resiliency can be obtained in different manners, e.g. in that the male part is provided with axial slots 19 in the material around the recess 16, and/or that the entire male part 14 is made in an elastic material, e.g. plastic. It hereby is essential that the dimensioning and the choice of material will provide sufficient axial stiffness.

As the male part 14 may be manufactured from plastic material in a moulding tool the manufacturing cost will be rather low.

By choosing an elastic material for the male part 14, it thus is possible, with or without slots, to obtain a sufficient resiliency for allowing an easy snapping-in of the male part 14 into the female part 7, thus that a satisfactory signal transferring contact is obtained in the coupling. Surprisingly this also has proven itself to be achievable also when the male part is made of plastic material.

By making the male part from an electrically non-conducting material, such as plastic material it is further achieved that the risk for transfer of electric current to the skull bone from external auxiliary apparatuses, such as tape recorders and the like is eliminated. This has not been possible to achieve earlier with both coupling parts made from an electrically conductive material.

Figure 3:
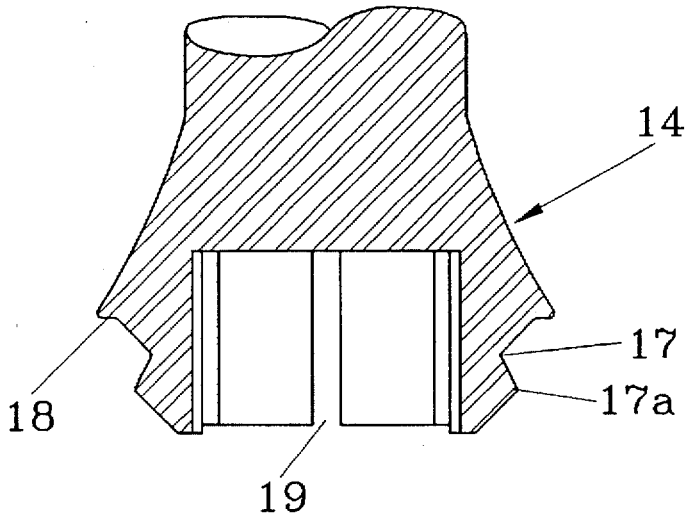
FIG. 3 shows in larger scale and in cross section an alternative embodiment of the second part of the coupling device shown in FIG. 1.

FIG. 3 shows in bigger scale and in cross section the second coupling part 14—the male part—in order to give a clear picture of its design in separate position.

Figure 4:
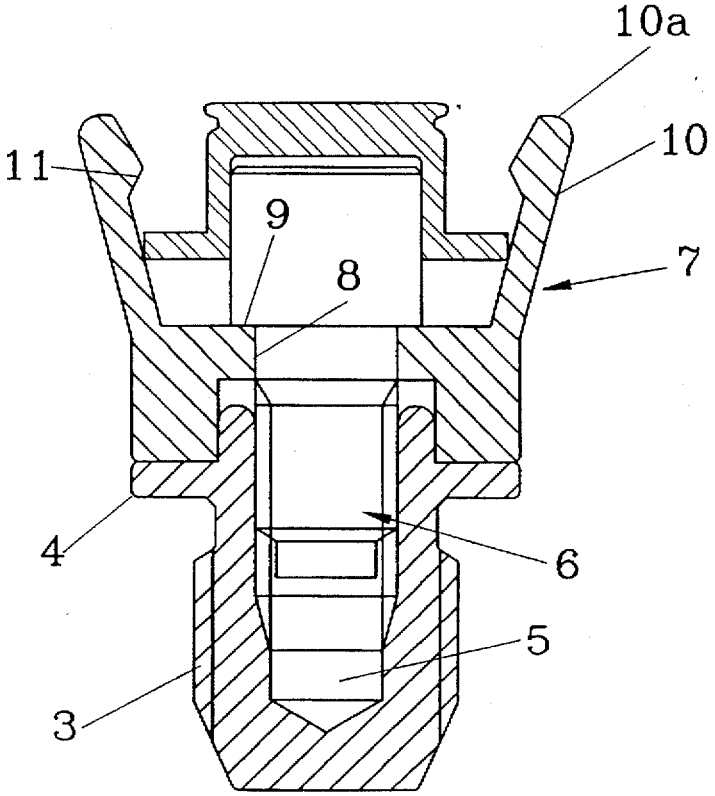
FIG. 4 is a cross section in bigger scale of the first coupling part of the coupling device shown in FIG. 1.

In FIG. 4 is shown in bigger scale the implant 2 and the first coupling part 7 in accordance with FIG. 1.

Figure 5:
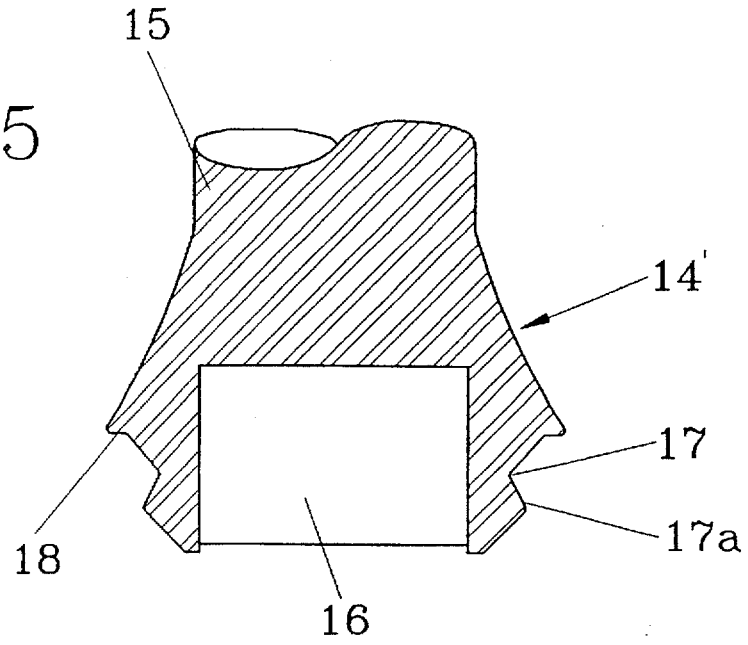
FIG. 5 shows in a view corresponding to FIG. 3 a further alternative of the second coupling part forming part of the coupling device according to the invention.

FIG. 5 shows in a view corresponding to FIG. 3 a further alternative embodiment of the second coupling part 14'—the male part—in this case made from an elastically resilient material, such as plastics, and for this reason the male part 14' in this case is made without axial slots.

Figure 6:
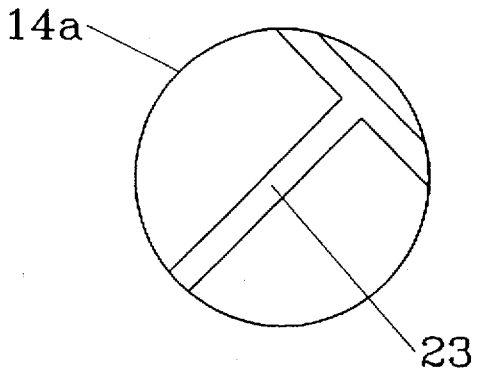
FIGS. 6–8 show schematically in end view the second coupling part and different types of recesses formed therein for increasing its flexibility.

FIG. 6 shows in a schematical end view a variant of the second coupling part, i.e. the male part 14*a* with resiliency increasing recesses in the form of a T-shaped slot or notch 23.

Figure 7:
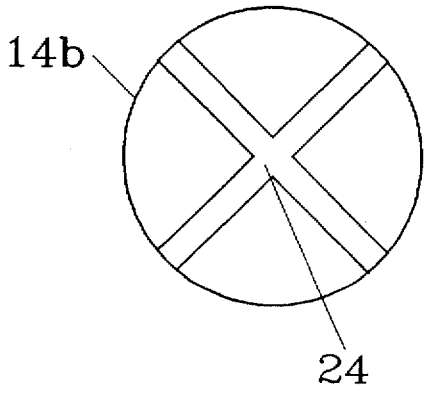

FIG. 7 is a view corresponding to FIG. 6 with a cross-formed recess 24 provided in the male part 14*b*.

Figure 8:
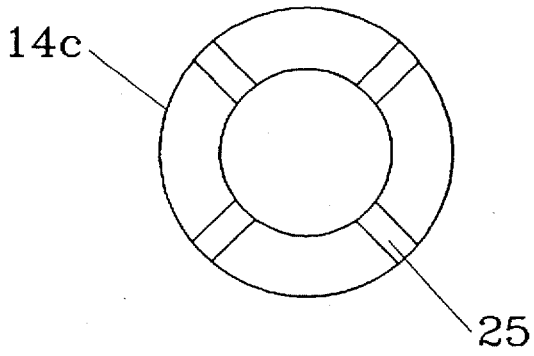

FIG. 8 finally illustrates in a view corresponding to FIGS. 6 and 7 how a male part 14*c* has been equipped with a recess 25 substantially corresponding to the recess according to FIG. 3, i.e. with a centrally disposed recess and with radial slots arranged through the annular wall.

All these schematically illustrated recesses, like several other not shown alternatives give a good radial resiliency to the male part.

By using an electrically non-conductive material, such as plastics, it is also achieved that the hearing aid can be connected to external electric aids without need of connecting protective transformer or the like.

Due to the design according to the invention described hereinbefore it is achieved that the patient part of the implant consists of a cylindrical, bored titanium socket having an continuous external surface, within which the radially resilient male part engages.

The invention is not limited to the embodiments illustrated in the accompanying drawings and described in connection thereto, but modifications and variations are possible within the scope of the accompanying claims.

We claim:

1. A device for interconnecting an implant for the hearing impaired comprising:

a substantially rigid, cylindrical, cup-shaped female coupling part with a cup-shaped opening having a circumferential annular bead on its inner periphery about the cup-shaped opening;

a substantially cylindrical, resilient, flexible male coupling part having a walled inner recessed portion in a first end and a circumferential groove about the outside of the recessed inner portion for receiving said annular bead thereby coupling with the female coupling part; and a vibration exciting apparatus connected to a second end of the male coupling part, wherein the male coupling part is resilient in the radial direction in order to permit snap-in introduction into the female coupling part; and the annular bead and groove engagement form a signal transferring surface between said male and female coupling parts.

2. A device as claimed in claim 1 wherein the male coupling part is manufactured from an elastically resilient material.

3. A device as claimed in claim 2 wherein the walled inner recessed portion of the male coupling part is provided with at least one slot thereby increasing its resiliency.

4. A device as claimed in claim 3 wherein the male part is made of plastic.

5. A device as claimed in claim 4 wherein the male part is made of an electrically non-conductive material.

6. A device as claimed in claim 1 wherein said female coupling part is adapted to be anchored to the skull bone of a person.

7. A device as claimed in claim 1 wherein said female coupling part is adapted to be connected to the implant which is to be anchored to the skull bone of a person.

* * * * *